US007997431B2

(12) United States Patent
Ladra et al.

(10) Patent No.: US 7,997,431 B2
(45) Date of Patent: Aug. 16, 2011

(54) OPERATING METHOD FOR AN INSTALLATION HAVING A MECHANICALLY MOVABLE ELEMENT

(75) Inventors: Uwe Ladra, Erlangen (DE); Elmar Schäfers, Fürth (DE); Torsten Schür, Erlangen (DE)

(73) Assignee: Siemens Aktiengesellschaft, Müchen (DE)

( * ) Notice: Subject to any disclaimer, the term of this patent is extended or adjusted under 35 U.S.C. 154(b) by 201 days.

(21) Appl. No.: 12/295,899

(22) PCT Filed: Mar. 8, 2007

(86) PCT No.: PCT/EP2007/052182
§ 371 (c)(1),
(2), (4) Date: Oct. 3, 2008

(87) PCT Pub. No.: WO2007/115874
PCT Pub. Date: Oct. 18, 2007

(65) Prior Publication Data

US 2009/0050593 A1 Feb. 26, 2009

(30) Foreign Application Priority Data

Apr. 3, 2006 (DE) ..... 10 2006 015 359

(51) Int. Cl.
*B66C 13/06* (2006.01)

(52) U.S. Cl. ..... 212/275; 212/270
(58) Field of Classification Search ..... 212/275, 212/270
See application file for complete search history.

(56) References Cited

U.S. PATENT DOCUMENTS

| | | | | |
|---|---|---|---|---|
| 4,816,731 | A * | 3/1989 | Boulton et al. | 318/569 |
| 6,961,628 | B2 * | 11/2005 | Yutkowitz | 700/37 |
| 7,727,051 | B2 * | 6/2010 | Martin et al. | 451/11 |
| 2003/0155881 | A1 * | 8/2003 | Hamann et al. | 318/569 |
| 2004/0236453 | A1 * | 11/2004 | Szoboszlay | 700/121 |
| 2005/0143847 | A1 * | 6/2005 | Papiernik | 700/61 |

FOREIGN PATENT DOCUMENTS

| | | | |
|---|---|---|---|
| DE | 42 08 717 | A1 | 10/1992 |
| DE | 39 24 256 | C2 | 1/1995 |
| DE | 43 27 951 | A1 | 2/1995 |
| DE | 199 07 989 | A1 | 10/1999 |
| DE | 199 20 431 | A1 | 11/2000 |
| DE | 102 00 680 | A1 | 8/2003 |
| EP | 0 768 587 | A1 | 4/1997 |

OTHER PUBLICATIONS

Scheffler, Feyrer, Matthias; Fördermaschinen; Vieweg Verlag S.: 220-224; Vieweg; 3-528-06626.1; Others; 1998.

* cited by examiner

*Primary Examiner* — Thomas J. Brahan
(74) *Attorney, Agent, or Firm* — Henry M. Feiereisen; Ursula B. Day

(57) ABSTRACT

An assembly has a mechanically movable element (1), by the movement of which an oscillatory system (2) can be excited to perform an oscillation which has a resonant frequency (f) and a corresponding oscillatory period (T). First of all, a control device (4) moves the mechanically movable element (1) at a first speed (v1). If the control device (4) is stipulated a second speed (v2) by an operator (7), the control device (4) determines a jolt profile, by means of which the speed (v) of the mechanically movable element (1) is changed to the second speed (v2), and moves the mechanically movable element (1) according to the determined jolt profile. Said control device (4) determines the jolt profile in such a way that an oscillation of the oscillatory system (2) which is excited at the beginning of the speed change is calmed at the end of the speed change.

9 Claims, 6 Drawing Sheets

FIG 10
Determine jerk profile r in such a way that the following holds:
1) $T1+T3=T2+T4$
2) $\iint r(t)d^2t=\delta v$
3) it holds at the end of the final section that: pendulum angle and pendulum speed = 0 — S6
4) $aM=RM\cdot T1$ and/or $aM=RM\cdot T4$
5) $\sum_{i=1}^{6} Ti \rightarrow \text{minimum}$
FIG 11
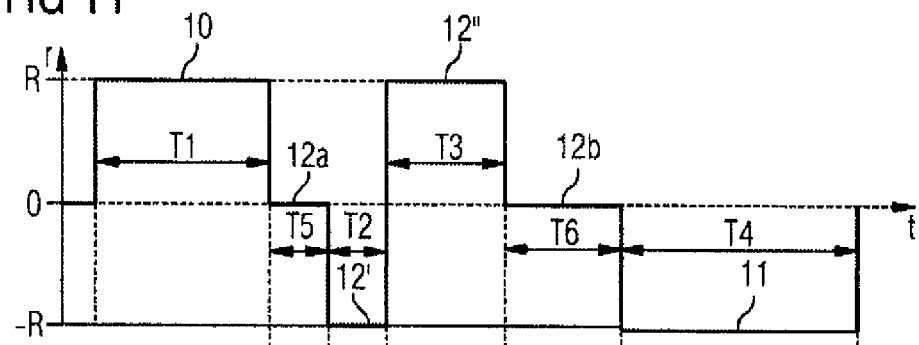
FIG 12
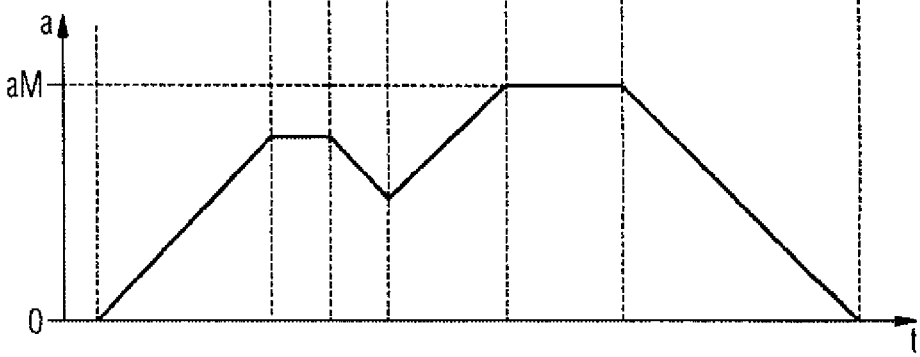

FIG 13
r = +R for t = 0 to T1
-R for t = T1 to T1+T2
+R for t = T1+T2 to T1+2T2
-R for t = T1+2T2 to 2T1+2T2
where $T2 = T1 - \sqrt{2T1^2 - \frac{|\delta v|}{R}}$ and $\frac{1}{2}\sqrt{2}\sqrt{\frac{|\delta v|}{R}} \leq T1 \leq \sqrt{\frac{|\delta v|}{R}}$
and T1 in such a way that excited oscillation of the load is damped.
S6
FIG 14
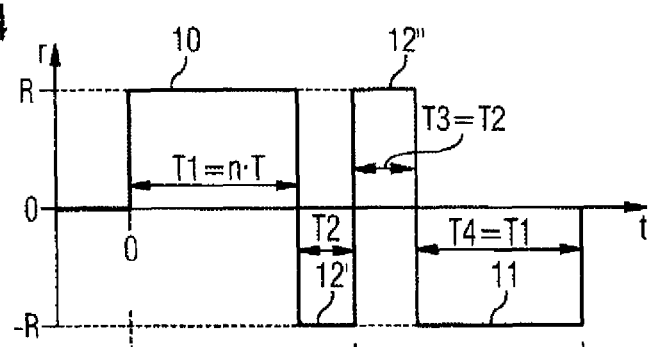
FIG 15
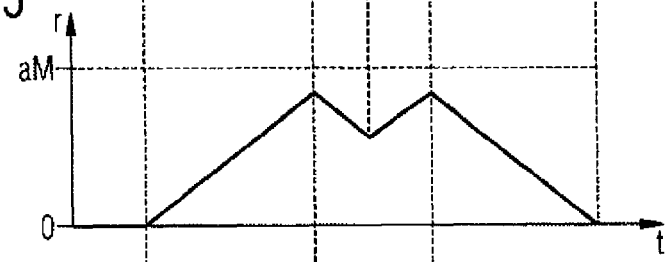
FIG 16
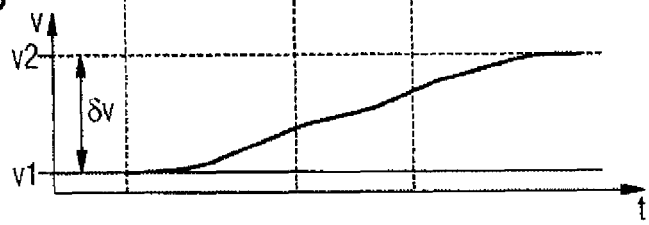

6/6

FIG 17

S6

Determine jerk profile r in such a way that the following holds:

1) Each jerk discontinuity can be represented as the sum of a first and second discontinuity component.
2) The first discontinuity component of a considered jerk discontinuity excites an oscillation of the oscillatory system.
3) The second discontinuity component of the considered jerk discontinuity damps an oscillation of the oscillatory system.
4) The oscillation damped by the second discontinuity component of the considered jerk discontinuity has been excited by the first discontinuity component of another jerk discontinuity.
5) The other jerk discontinuity lies temporally upstream of the considered jerk discontinuity by half an oscillatory period.

FIG 18

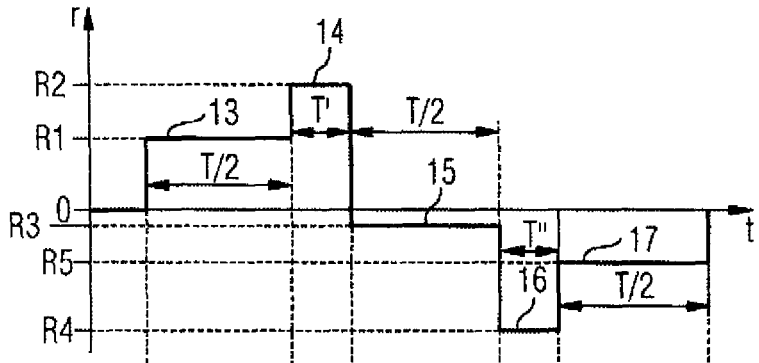

FIG 19

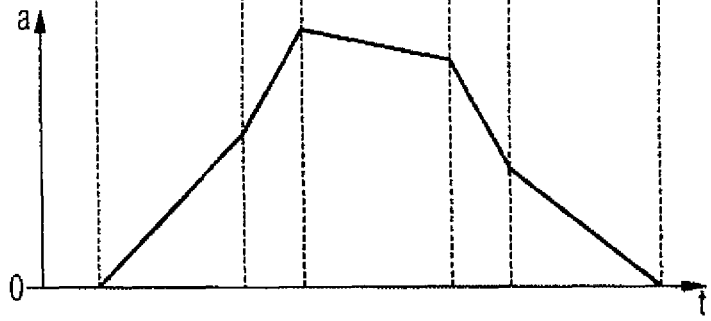

OPERATING METHOD FOR AN INSTALLATION HAVING A MECHANICALLY MOVABLE ELEMENT

BACKGROUND OF THE INVENTION

The present invention relates to an operating method for an installation having a mechanically movable element which, by moving, can excite an oscillatory system to perform an oscillation that has a natural frequency and an oscillatory period corresponding to the natural frequency.

Such operating methods are generally known. They are designed partially in an automated fashion, partially in a manual fashion. Examples of appropriate installations are, for example, crane installations by means of which a load is shifted. The mechanically movable element consists in this case of a trolley or a similar load holder, while the oscillatory system consists of the load hanging on a cable. Other configurations are also conceivable, for example a shaft conveyer system having a conveyer cage. In this case, the mechanically movable element corresponds to the conveyer drive, the cable pulley or the like, while the oscillatory system corresponds to the conveyer cage and the support cable.

When the mechanically movable element is automatically moved, a target location, a target position or the like are known to the control device during movement processes. There have long been known, for such types of operation, procedures by means of which movement processes can be controlled in such a way that load oscillation (or, more generally, oscillation of the oscillatory system) at the target location is damped.

DE-C-39 24 256 discloses an operating method for an installation of the type mentioned at the beginning that runs manually. "Manually" means in this case that the operator prescribes for the control device only the speed at which the mechanically movable element is to be moved. In the case of the operating method known from DE-C-39 24 256, the movement of the load is controlled by forward or backward movement and/or acceleration or deceleration of the movement such that load oscillation in the course of the transport path at the end of each acceleration or deceleration phase is compensated to vanish.

SUMMARY OF THE INVENTION

The object of the present invention consists in specifying an operating method of the type mentioned at the beginning in the case of which—just as with the operating method of DE-C-39 24 256—an oscillation of the oscillatory system excited at the beginning of a change in speed is damped at the end of the change in speed. The inventive method is intended, however, to be easier and more convenient to handle. In particular, it is to be ensured in a simple way that dynamic limits of the movement are observed.

The object is achieved by an operating method for an installation having a mechanically movable element which, by moving, can excite an oscillatory system to perform an oscillation that has a natural frequency and an oscillatory period corresponding to the natural frequency, wherein a control device firstly moves the mechanically movable element at a speed that has a first speed value, wherein the control device is then prescribed a second speed value by an operator, wherein the control device determines a jerk profile upon prescription of the second speed value, wherein the control device determines the jerk profile in such a way that the speed for the mechanically movable element is changed from the first to the second speed value, and an oscillation of the oscillatory system excited at the beginning of the speed change is damped at the end of the speed change, and wherein the control device moves the mechanically movable element in accordance with the determined jerk profile.

The first and second speed values are—within the range of the speed values possible in principle—capable of being prescribed at will. In particular, one of the two speed values can vanish. In one case, the inventive operating method is a starting process of the mechanically movable element, while in another case it is a stopping process. However, changes in speed are also possible during the movement operation as such, specifically changes in movement both with and without reversal of the direction of movement.

The jerk profile preferably consists of sections, the jerk being sectionwise constant. In this case, the operating method can be implemented with particular ease.

In a first possible refinement of the inventive operating method, the jerk profile has an initial section and a final section. In this refinement, the jerk has jerk values of the same magnitude and different sign in the initial section and in the final section.

It is possible for the initial section and the final section to have mutually identical section lengths and for the section lengths of the initial section and the final section to be an integral multiple of the oscillatory period. In this case, the jerk profile is frequency-tuned. The mechanically movable element, and also the installation as a whole and the oscillatory system are comparatively lightly loaded by this mode of procedure. The section lengths of the initial and final sections can, in particular, be equal to the oscillatory period itself.

When the section lengths of the initial and final sections of the control device can be set, it preferably determines the section lengths in such a way that the magnitudes of the jerk values of the initial and final sections still just do not exceed a maximum jerk.

The maximum jerk can be permanently prescribed for the control device. It is preferably prescribed for the control device by the operator.

The control device preferably determines the jerk values of the initial and final sections in such a way that the magnitude of the product of the jerk value and the section lengths of the initial and final sections does not exceed a maximum acceleration. It is thereby possible, in particular, reliably to avoid overloading the drive system by means of which the mechanically movable element is moved.

By analogy with the maximum jerk, it is also possible to permanently prescribe the maximum acceleration for the control device. It is preferably prescribed for the control device by the operator.

It is possible that the control device inserts between the initial and final sections an additional section in which the jerk vanishes. In this case, the control device determines a section length of the additional section in such a way that a change in speed effected overall by the initial, the additional and the final sections corresponds to the difference between first and second speed values.

It is possible that the control device always inserts the additional section. The control device preferably inserts the additional section only when without the insertion of the additional section the jerk values of the initial and final sections would have to exceed the maximum jerk and/or the magnitude of the acceleration at the end of the initial section would exceed the maximum acceleration.

When the additional section is not inserted, the initial and final sections adjoin one another.

The initial and final sections can also have section lengths that are not necessarily an integral multiple of the oscillatory period. In this case, the control device inserts between the initial and final sections a first and a second intermediate section. The first intermediate section lies upstream of the second intermediate section and adjoins the second intermediate section. The jerk in the first intermediate section is equal to the jerk in the final section, and the jerk in the second intermediate section is equal to the jerk in the initial section.

The second speed value can be reached more quickly by means of the last described mode of procedure than with the frequency-tuned mode of procedure. The last described mode of procedure is even time-optimum when the magnitude of the jerk value in the initial, the final and the intermediate sections is equal to a maximum jerk.

In the case of this mode of procedure, as well, the maximum jerk can be permanently prescribed for the control device. It is preferably prescribed for the control device by the operator.

The control device preferably determines the section lengths of the initial and final sections in such a way that the magnitude of the product of the jerk value and the section lengths of the initial and final sections does not exceed a maximum acceleration.

In a way similar to the maximum jerk, the maximum acceleration can be permanently prescribed for the control device. It is preferably prescribed for the control device by the operator.

It is possible that the control device inserts between the initial section and the first intermediate section a first additional section in which the jerk vanishes. Alternatively, or in addition, it is also possible that the control device inserts between the second intermediate section and the final section a second additional section in which the jerk vanishes.

It is possible that the control device always inserts the first and/or the second additional section. The control device preferably inserts the first and/or the second additional section only when without the insertion of the first and/or the second additional section the magnitude of the acceleration at the end of the initial section and/or at the start of the final section would exceed the maximum acceleration.

When the control device does not insert the first and second additional sections, the first intermediate section adjoins the initial section and the second intermediate section adjoins the final section.

The section lengths of the individual sections are preferably determined by the control device in such a way that the sum of the section lengths is minimal. It is possible that the additional sections and/or the intermediate sections have a vanishing time duration in the individual case. It is even possible in the individual case that the initial section and the final section directly adjoin one another. When the intermediate sections vanish (i.e have vanishing section lengths), the jerk profile corresponds to a frequency-tuned jerk profile.

Neither the frequency-tuned mode of procedure nor the time-optimized mode of procedure are linear. With these two modes of procedure, it is therefore necessary firstly to reach the second speed value. Only thereafter is it possible to change the speed anew. However, it is also possible to determine the jerk profile in such a way that jerk profiles can be superposed on one another.

For example, the control device can determine the jerk profile in such a way that each jerk discontinuity resulting at the start and at the end of the jerk profile as well as at the transition between two sections can be represented as the sum of a first and a second discontinuity component, and the first discontinuity component of a considered jerk discontinuity excites an oscillation of the oscillatory system and the second discontinuity component of the considered jerk discontinuity damps an oscillation of the oscillatory system that has been excited by the first discontinuity component of another jerk discontinuity that lies temporally upstream of the considered jerk discontinuity by half an oscillatory period.

The discontinuity components of a jerk discontinuity can be greater than zero or smaller than zero. They can have the same sign or different signs, if appropriate even compensate one another. Again, one of the two discontinuity components can vanish per jerk discontinuity.

One of a number of possible refinements of this method is characterized in that the jerk profile consists of exactly five directly consecutive sections, and the first, the third and the fifth sections respectively have a section length that is equal to half the oscillatory period.

The jerk values preferably fulfill the following relationships in the case of the last described mode of procedure:

- the jerk value of the second section has the same sign as the jerk value of the first section and lies between the onefold value and the twofold value of the jerk value of the first section,
- the jerk value of the fifth section has a different sign from the jerk value of the first section, and
- the jerk value of the fourth section has the same sign as the jerk value of the fifth section and lies at least the twofold value of the jerk value of the fifth section.

The magnitudes of the jerk values of the second and fourth sections are preferably equal. In this case, the second and fourth sections have mutually identical section lengths. Furthermore, the jerk value of the third section lies between the jerk value of the first section and the jerk value of the fifth section. This mode of procedure yields a simpler determination of the section lengths of the second and fourth sections.

The magnitude of the jerk value of the second section and/or the magnitude of the jerk value of the fourth section are/is preferably a maximum jerk. It is possible thereby for the time required to reach the second speed value to be kept low.

The maximum jerk can—as previously—be permanently prescribed for the control device, or be prescribed by the operator.

The natural frequency and the oscillatory period corresponding to the natural frequency can also be permanently prescribed for the control device. Alternatively it is possible for the operator to prescribe these variables for the control device. However, the control device preferably detects at least one measured variable of the oscillatory system by means of a sensor device and automatically determines the natural frequency and the oscillatory period by using the at least one measured variable.

The present invention relates not only to the operating methods explained above. It also relates to a data medium on which a computer program is stored, in which the computer program causes a control device to operate an installation in accordance with an operating method of the type described above when the computer program is loaded into the control device and is executed by the control device.

Furthermore, the present invention also relates to a control device for such an installation, the control device being designed, in particular being programmed, in such a way that it can execute such an operating method.

Finally, the present invention also relates to an installation having a mechanically movable element which, by moving, can excite an oscillatory system to perform an oscillation that has a natural frequency and an oscillatory period corresponding to the natural frequency, it being possible for the mechanically movable element to be moved by a control device in accordance with one of the above-described operating methods.

BRIEF DESCRIPTION OF THE DRAWING

Further advantages and details emerge from the following description of exemplary embodiments in conjunction with the drawings, in which, in schematic representation:

FIG. 10 shows a further possible implementation of the step of the flowchart of FIG. 2, FIGS. 11 and 12 show timing diagrams, FIG. 13 shows a special case of FIG. 10, FIGS. 14 to 16 show timing diagrams, FIG. 17 shows a further possible implementation of the step of the flowchart of FIG. 2, and FIGS. 18 and 19 show timing diagrams.

DETAILED DESCRIPTION OF PREFERRED EMBODIMENTS

Figure 1:
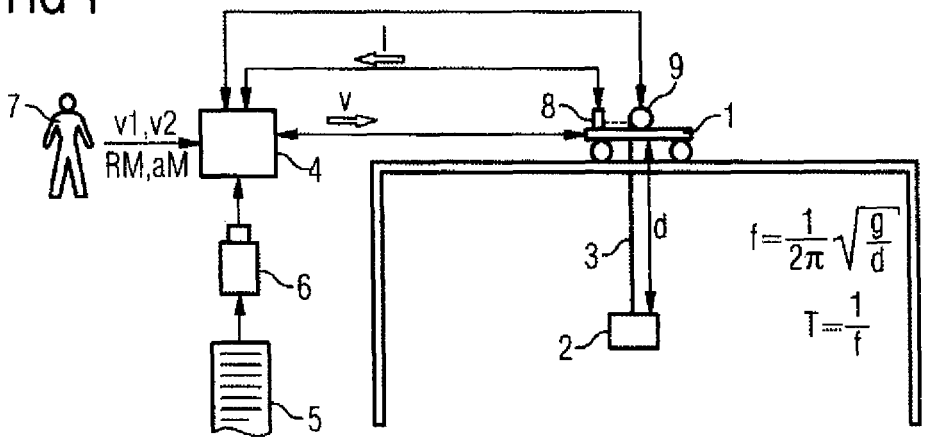
FIG. 1 shows by way of example an installation having a mechanically movable element.

According to FIG. 1, an installation is designed by way of example as a crane. The crane has, for example, a horizontally movable trolley 1. A load 2 that hangs on a cable 3 can be moved by moving the trolley 1. Swinging of the load 2 can be excited by the movement of the trolley 1. It is an object of the present invention to prevent such a swinging of the load 2 during movement of the trolley 1.

In accordance with the exemplary configuration of FIG. 1, the trolley 1 corresponds to a mechanically movable element 1 of the installation. The load 2 hanging on the cable 3 corresponds to an oscillatory system 2. The movement of the trolley 1 corresponds to the movement of the mechanically movable element 1. The present invention is explained in more detail below in conjunction with this exemplary configuration. The present invention is, however, not restricted to crane installations. However, crane installations constitute the most frequent and typical application of the present invention.

When the load 2 is swinging, the pendulum oscillation has a natural frequency f that is determined by a distance d of the load 2 from the trolley 1, that is to say by the pendulum length d. It holds that $$f = \frac{1}{2\pi}\sqrt{\frac{g}{d}}. \tag{1}$$

In this formula, g is the acceleration due to gravity, being approximately 9.81 $m/s^2$.

An oscillatory period T corresponds to the natural frequency f. It is yielded as the reciprocal of the natural frequency f.

The crane has a control device 4 inter alia. The control device 4 is designed in such a way that it controls the crane in accordance with an operating method that is explained below in more detail in conjunction with FIG. 2. For example, the control device 4 can be designed as a programmable control device 4. In this case, the control device 4 is programmed by means of a computer program 5 in such a way that it executes the appropriate operating method.

The computer program 5 can, for example, be stored on a data medium 6 and have the effect that the control device 4 executes the abovementioned operating method when the computer program 5 is loaded into the control device 4 and is executed by the control device 4. The data medium 6 can be a mobile data medium 6, for example, a USB memory stick 6. It can also be a stationary data medium, for example, a hard disk of a server. In this case, the computer program 5 is fed to the control device 4 via a network link (not illustrated).

The trolley 1 is moved under speed control in the inventive operating method. No position adjustment takes place. Being driven by a drive (not illustrated) of the trolley 1 in accordance with FIG. 2, the control device 4 therefore firstly moves the trolley 1, in a step S1, at a speed v, which has a first speed value v1. The first speed value v1 is also denoted below as initial speed v1.

The initial speed v1 can—within a speed range that is possible in principle—have any desired value. In particular, it can be greater than zero (that is to say, a forward movement of the trolley 1 is performed), be smaller than zero (that is to say, a backward movement of the trolley 1 is performed), or can vanish (that is to say, the trolley 1 stands still).

In a step S2, the control device 4 receives a jerk value RM from an operator 7. The prescribed jerk value RM corresponds to a maximum jerk RM that can be applied to the trolley 1.

In a step S3, the control device 4 further receives an acceleration value aM from the operator 7. The prescribed acceleration value aM corresponds to a maximum acceleration aM that can be applied to the trolley 1.

Steps S2 and S3 are only optional. They are illustrated only with dashes in FIG. 2, for this reason. If step S2 is not present, either the maximum jerk RM is permanently prescribed for the control device 4, or there is no maximum jerk RM. If step S3 is not present, either the maximum acceleration aM is permanently prescribed or there is no maximum acceleration aM.

In a step S4, the control device 4 checks as to whether the operator 7 has prescribed it a second speed value v2. The second speed value v2 is also denoted below as final speed v2. By analogy with the first speed value v1, it can be prescribed at will. It only has to differ from the first speed value v1.

When no second speed value v2 has been prescribed for the control device 4, the control device 4 returns to step S1. Otherwise, it proceeds to a step S5.

In step S5, the control device 4 uses a suitable sensor device 8 to detect at least one measured variable 1 that is characteristic of the natural frequency f of the load 2. For example, the sensor device 8 can be used to detect a cable length 1 dereeled from a cable drum 9, which has a linear relationship to the distance d of the load 2 from the trolley 1.

Likewise, in the context of step S5, the control device 4 uses the detected measured variable(s) 1 to automatically determine the natural frequency f and the oscillatory period T.

Like steps S2 and S3, step S5 is only optional. It too is illustrated only with dashes in FIG. 2 for this reason. If it is absent, the natural frequency f and the oscillatory period T of the control device 4 must be known in some other way. For example, they can be permanently prescribed or be prescribed by the operator 7.

The control device 4 next determines a jerk profile r as a function of time t in a step S6. In the context of step S6, the control device 4 determines the jerk profile r in such a way that the speed v of the trolley 1 is changed from the initial speed v1 to the final speed v2.

An oscillation of the load 2 is excited at the beginning of the change in the speed v on the basis of the change in the speed v of the trolley 1. This excitation is unavoidable. However, the jerk profile r is determined by the control device 4 in step S6 in such a way that the oscillation at the end of the change in speed, that is to say when the final speed v2 is reached, is damped.

In a step S7, the control device 4 moves the trolley 1 in accordance with the jerk profile r determined in step S6. Starting from when the final speed v2 is reached, the load 2 no longer swings until the speed v of the trolley 1 is changed anew.

When the final speed v2 is reached, the control device 4 sets the initial speed v1 to the value of the final speed v2 that has now been reached, and returns to step S1.

Various possibilities by means of which step S6 of FIG. 2 can be implemented are explained below in conjunction with FIGS. 3 to 19. The jerk profile r consists of sections for each of these possibilities. The jerk r is constant in each case within the sections. It therefore changes only at the section boundaries. In principle, however, it would also be possible to change the jerk r continuously and constantly.

It will always be assumed below in conjunction with FIGS. 3 to 19 that the final speed v2 is greater than the initial speed v1, and thus that the initial and the final speeds v1, v2 correspond to a positive speed difference δv. This assumption does not constitute a restriction. In the opposite case, that is to say when the final speed v2 is smaller than the initial speed v1, it is necessary only to multiply the jerk profiles r described below by the factor −1. Thus, all that is required is a change of sign in the case of the inventively determined jerk profiles r.

In conjunction with FIGS. 3 to 9, the first step below is to explain in more detail a frequency-tuned method for determining the jerk profile r.

Figure 2:
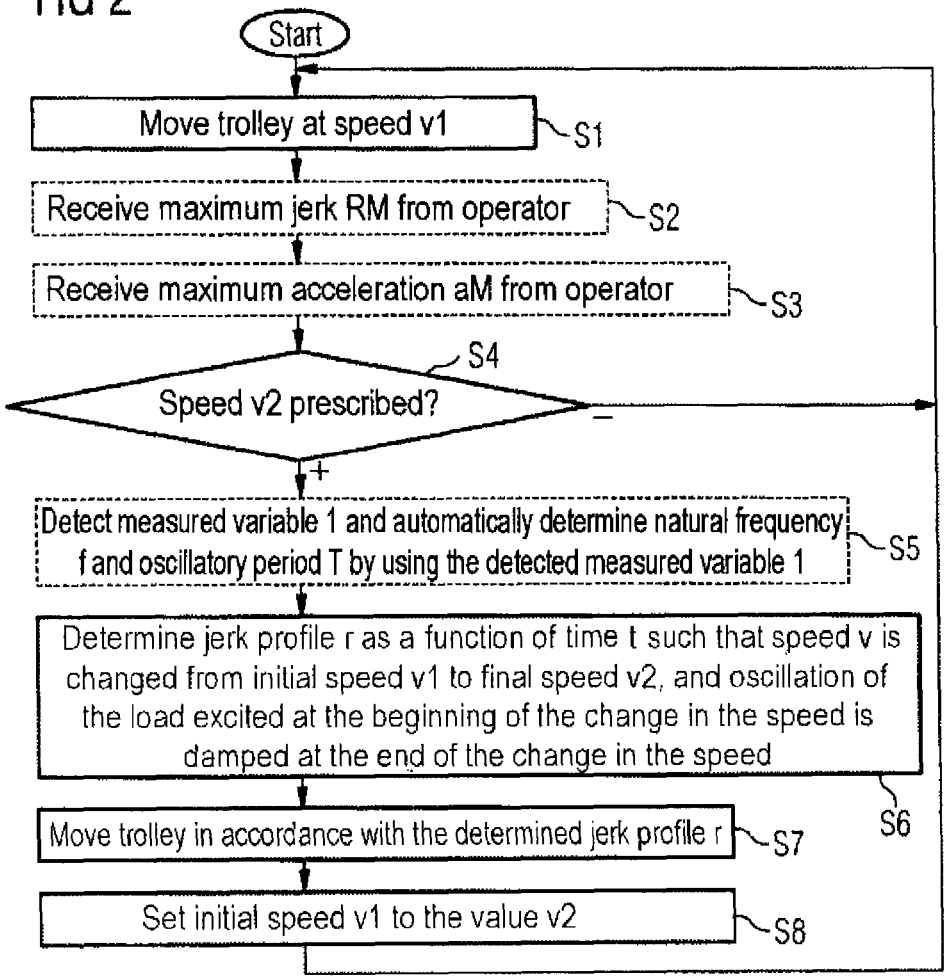
FIG. 2 shows a flowchart.
Figure 3:
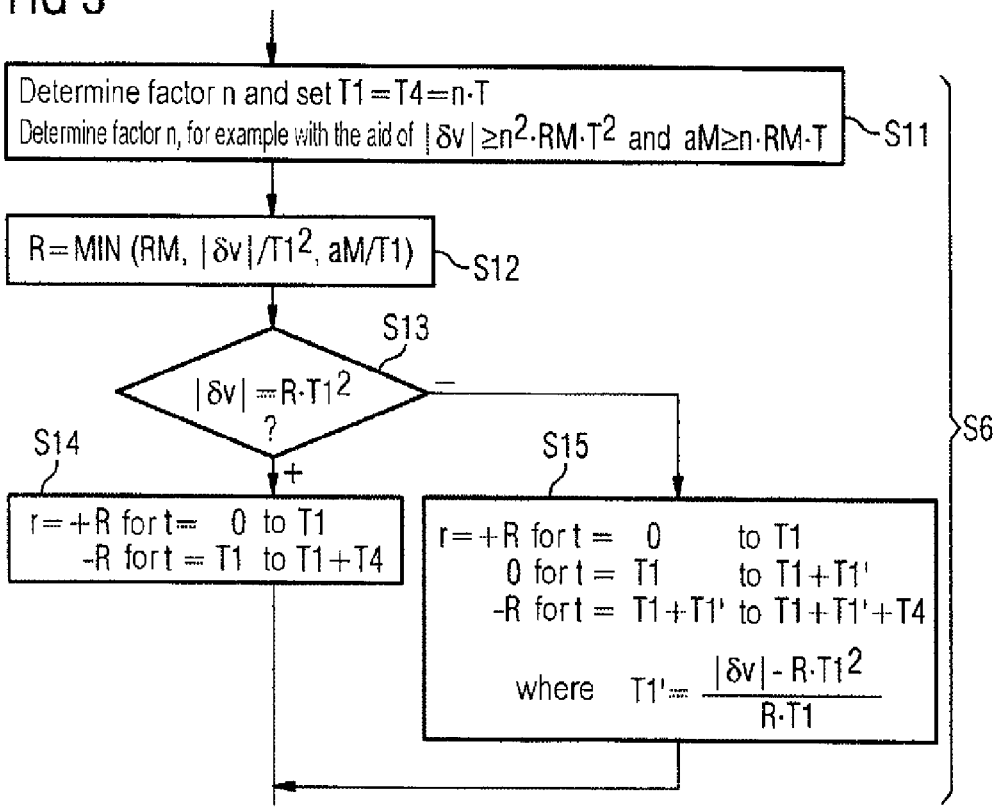
FIG. 3 shows a possible implementation of a step of FIG. 2, FIGS. 4 to 9 show timing diagrams.

In accordance with FIG. 3, in order to implement step S6 of FIG. 2 it is possible, for example, firstly to determine a factor n in a step S11. The factor n is a whole number that is greater than zero, that is to say can assume the values 1, 2, 3 etc. It can be bounded above. The product of the factor n with the oscillatory period T yields—compare FIG. 4-*section* lengths T1, T4 of an initial section 10 and a final section 11 of the jerk profile r being sought.

In order to determine the factor n, the factor n can, for example, firstly be set to the value one, and it can be checked whether the relationships $$|\delta v| \geqq n^2 \cdot RM \cdot T^2 \tag{2}$$

and $$aM \geqq n \cdot RM \cdot T \tag{3}$$

are fulfilled. If both the relationships are fulfilled, the factor n is increased by 1 and the relationships are checked anew. As soon as one of these two relationships is no longer fulfilled, the factor n is set to the value for which these two relationships are last fulfilled, or for which at least one of the two relationships is no longer fulfilled for the first time.

If appropriate, the following steps S12 to S15 can also be run through for both possible values of the factor n, and then it is finally possible to use that one of the two possible values as factor n for which the jerk profile r that is determined in the course of steps S12 to S15 requires the shorter overall time to reach the final speed v2.

Step S11 can also be omitted. In this case, the factor n is permanently prescribed. For example, it can always have the value n=1 or n=2. Corresponding thereto, the section lengths T1, T4 of the initial and final sections 10, 11 are permanently prescribed in this case.

In the mode of procedure of FIG. 3, the section lengths T1, T4 of the initial section 10 and the final section 11 are, on the one hand, mutually identical and, on the other hand, are an integral multiple of the oscillatory period T.

In accordance with FIG. 3, after the determination of the factor n, a jerk value R is firstly determined in step S12 as the minimum of the maximum jerk RM and the two terms $|\delta v|/T1^2$ and aM/T1. This jerk value R is assigned to the initial and final sections 10, 11—once with the positive and once with the negative sign.

The jerk value R fulfills the condition that its magnitude is below the maximum jerk RM or that at least it does not exceed the maximum jerk RM. The section length T1 of the initial and final sections 10, 11 is thus determined in such a way that the magnitudes of the jerk values +R, −R still just do not exceed the maximum jerk RM. Furthermore, the jerk value R fulfills the condition that the product of the section lengths T1, T4 of the initial and final sections 10, 11 and of the jerk value R lies below the maximum acceleration aM or at least does not exceed the maximum acceleration aM.

Figure 4:
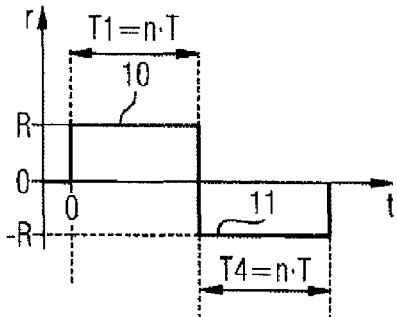
Figure 5:
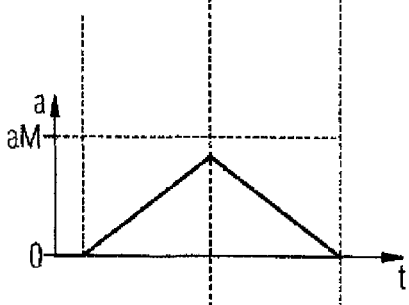
Figure 6:
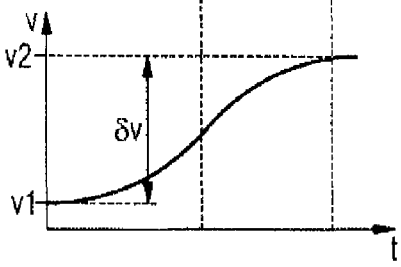

In step S13, the control device 4 checks as to whether the final speed v2 is reached only by means of the initial and final sections 10, 11. When the final speed v2 is reached, the control device 4 determines the jerk profile r in step S14 by assigning the jerk value +R to the initial section 10 and the jerk value −R to the final section 11. The initial section 10 and the final section 11 directly adjoin one another in this case. This case is illustrated in FIGS. 4 to 6. FIG. 4 shows the jerk profile r, FIG. 5 the corresponding acceleration profile a, and FIG. 6 the corresponding profile of the speed v.

When the final speed v2 is not reached by means of the initial and final sections 10, 11, in step S15 the control device 4 inserts between the initial and final sections 10, 11 an additional section 12 in which the jerk r vanishes. In this case, the control device 4 determines a section length T1' of the additional section 12 in such a way that a change in speed effected overall by the initial, additional and final sections 10, 12, 11 corresponds to the desired speed difference δv. In particular, the section length T1' of the additional section 12 is yielded as $$T1' = \frac{|\delta v| - R \cdot T1^2}{R \cdot T1}. \tag{4}$$

Figure 7:
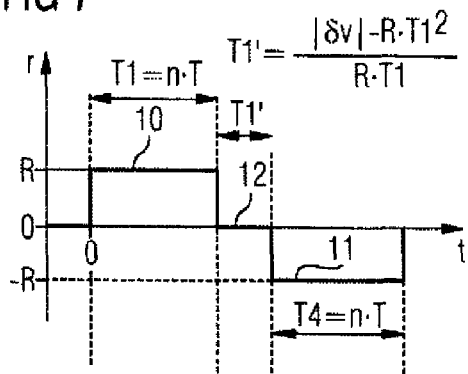
Figure 8:
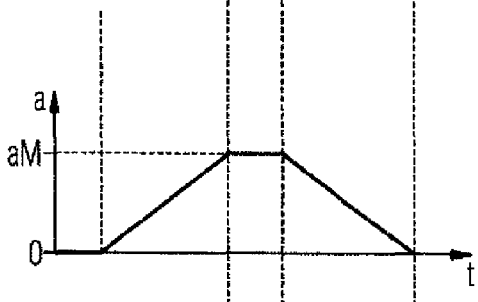
Figure 9:
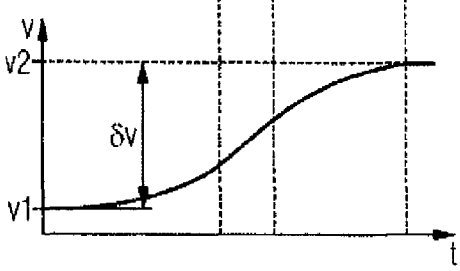

This case is illustrated in FIGS. 7 to 9. FIG. 7 shows the jerk profile r that results, FIG. 8 the corresponding acceleration profile a and FIG. 9 the corresponding profile of the speed v.

The way the jerk value R is determined in step S12 ensures that step S15 is executed only whenever, in the case of given section lengths T1, T4 of the initial and final sections 10, 11, without the insertion of the additional section 12, the jerk value R would have to exceed the maximum jerk RM in order to effect the desired speed difference δv and/or the magnitude of the acceleration a at the end of the initial section 10 would exceed the maximum acceleration aM.

The way the section length T1 of the initial section 10 is determined ensures that the pendulum speed of the load 2 relative to the trolley 1 and the pendulum acceleration of the load 2 relative to the trolley 1 vanish at the end of the initial section 10. By contrast, a pendulum angle exhibited by the load 2 relative to the trolley 1 does not vanish. Furthermore, the way the section length T4 of the final section 11 is determined ensures that the pendulum angle and the pendulum speed of the load 2 relative to the trolley 1 vanish at the end of the final section 11. As a result, an oscillation of the load 2 that is excited at the beginning of the change in speed is damped at the end of the change in speed.

Because of the circumstance that the pendulum speed and the pendulum acceleration of the load 2 relative to the trolley 1 vanish at the end of the initial section 10, there is, moreover, no excitation of a load swing in the additional section 12 (if the additional section 12 is present). Rather, the pendulum angle of the load 2 relative to the trolley 1 remains constant throughout the entire additional section 12.

A time-optimized operating method is now explained in the most general case below in conjunction with FIGS. 10 to 12. FIG. 10 shows the appropriate step S6 of the operating method, FIG. 11 the corresponding jerk profile r, and FIG. 12 the corresponding acceleration profile a.

In accordance with FIGS. 10 and 11, the jerk profile r determined by the control device 4 has an initial section 10 and a final section 11. Inserted between the initial section 10 and the final section 11 are intermediate sections 12', 12" that are denoted below as first intermediate section 12' and as second intermediate section 12", in order to distinguish between them.

The magnitude of the jerk r in the initial section 10 is preferably equal to the maximum jerk rM. The jerk r in the final section 11 has the same magnitude as the jerk r in the initial section 10, but differs in sign.

The first intermediate section 12' lies upstream of the second intermediate section 12" and adjoins the second intermediate section 12". The intermediate sections 12', 12" have section lengths T2, T3. The jerk r in the first intermediate section 12' is equal to the jerk r in the final section 11. The jerk r in the second intermediate section 12" is equal to the jerk r in the initial section 10.

It is possible for the first intermediate section 12' to adjoin the initial section 10, and for the second intermediate section 12" to adjoin the final section 11. However, the general case is such that

- the control device 4 inserts between the initial section 10 and the first intermediate section 12' a first additional section 12*a* in which the jerk r vanishes, and/or
- the control device 4 inserts between the second intermediate section 12" and the final section 11*a* second additional section 12*b* in which the jerk r vanishes.

If it is present, the first intermediate section 12*a* has a section length T5. Similarly, if it is present, the second intermediate section 12*b* has a section length T6.

It is possible in principle for the control device 4 to always insert one or even both of the additional sections 12*a*, 12*b* into the jerk profile r. However, the insertion of the additional sections 12*a*, 12*b* is preferably performed only when without the insertion of the first and/or of the second additional section 12*a*, 12*b* the magnitude of the acceleration a at the end of the initial section 10 and/or at the start of the final section 11 would exceed the maximum acceleration aM.

When the jerk profile r exhibits not only the initial section 10 and the final section 11, but also the intermediate sections 12', 12" and the additional sections 12*a*, 12*b*, the following conditions determine the section lengths T1 to T6 of the sections 10, 11, 12', 12", 12*a*, 12*b* in accordance with FIG. 10:

- the sum of the section lengths T1, T3 of the initial section 10 and of the second intermediate section 12" is equal to the sum of the section lengths T2, T4 of the first intermediate section 12' and of the final section 11.
- The jerk profile corresponds to the desired speed difference δv. The integral of the acceleration profile a determined by the jerk profile r must therefore correspond to the speed difference 8*v*.
- The pendulum angle of the load 2 and the first time derivative of the pendulum angle (that is to say the pendulum speed) must vanish at the end of the final section 11.
- The section length T1 of the initial section 10 and/or the section length T4 of the final section 11 must be given by an installation condition. For example, the section lengths T1, T4 (or one of the section lengths T1, T4) can be determined by virtue of the fact that the product of the relevant section length T1, T4 and of the jerk value r is equal to the maximum acceleration aM. In particular, in this case the corresponding section lengths T1, T4 are determined by the control device 4 in such a way that the relevant product does not exceed the maximum acceleration aM.
- The sum of the times T1 to T6 is minimal.

The above statements are generally valid. They are valid irrespective of whether the oscillation of the oscillatory system 2 (here the load 2) is a damped or an undamped oscillation. The damping can be neglected in a multiplicity of applications. The jerk profile r is symmetrical in this case. It follows that in this case:

- the initial section and the final section 10, 11 exhibit mutually identical section lengths T1, T4.
- The intermediate sections 12', 12" exhibit mutually identical section lengths T2, T3.
- If they are present, the additional sections 12*a*, 12*b* exhibit mutually identical section lengths T5, T6.

In a multiplicity of applications, the desired speed difference 8*v* can be reached without having to insert the additional sections 12*a*, 12*b* into the jerk profile r. In this case, the first intermediate section 12' adjoins the initial section 10. The second intermediate section 12" adjoins the final section 11.

The frequently occurring case in which the damping can be neglected and the desired speed difference δv can be reached without having to insert the additional sections 12*a*, 12*b* into the jerk profile r is explained in more detail below in conjunction with FIGS. 13 to 16. FIG. 13 shows the corresponding step S6 of the operating method, while FIG. 14 shows the corresponding jerk profile r. FIG. 15 shows the corresponding acceleration profile a, while FIG. 16 shows the corresponding profile of the speed v.

The jerk profile r to be determined is intended to effect overall the desired speed change δv. Consequently, the relationship $$T1^2 + 2 \cdot T1 \cdot T2 - T2^2 = \frac{|\delta v|}{R} \tag{5}$$

must be valid.

The determined jerk profile r is, furthermore, to be time-optimized. Consequently, one of the two solutions of the quadratic equation 5 can be eliminated. It therefore holds that $$T2 = T1 - \sqrt{2T1^2 - \frac{|\delta v|}{R}}\,. \tag{6}$$

Finally, the section length T2 of the intermediate sections 12', 12" must be real and greater than zero (or at least equal to zero). It therefore also holds that $$\frac{1}{2}\sqrt{2}\sqrt{\frac{|\delta v|}{R}} \leq T1 \leq \sqrt{\frac{|\delta v|}{R}}. \quad (7)$$

In principle, two modes of procedure are possible for determining the section length T1 of the initial and final sections 10, 11 in such a way that the oscillation of the load 2 excited at the beginning of the speed change is damped at the end of the speed change.

Firstly, it is possible to prepare an analytical solution for the section length T1 of the initial and final sections 10, 11. This mode of procedure is, however, very complicated and laborious. Given a known jerk R and known speed difference δv for a number of permissible values of the section length T1 of the initial and final sections 10, 11, it is much easier firstly to determine the corresponding section length T2 of the intermediate sections 12', 12", and then to determine a corresponding residual excitation of the oscillation at the end of the jerk profile r. It is possible in this case to make use of that value of the section length T1 of the initial and final sections 10, 11 for which the residual excitation is minimal. If appropriate, this determination can be performed in multistage fashion, that is to say the interval within which the section length T1 of the initial and final sections 10, 11 is determined is gradually reduced in a number of stages.

It follows from the statements above that the section length T2 of the intermediate sections 12', 12" can vanish in the extreme case. This case can, however, occur only when the section length T1 of the initial and final sections 10, 11 happens to be an integral multiple of the oscillatory period T. In this special case, the frequency-tuned mode of procedure and the time-optimized mode of procedure can lead to the same result through different paths. This is valid both with and without insertion of the additional sections 12*a*, 12*b*.

The operating methods explained above in conjunction with FIGS. 3 to 16 are not linear. Each change in speed or each determined jerk profile r must firstly be terminated. Only thereafter is it permissible to perform a new prescription of speed.

However, it is also possible to determine the jerk profile r in such a way that it is possible to superpose on one another jerk profiles r resulting from different changes in speed. One example of such a mode of determination is described below in more detail in conjunction with FIGS. 17 to 19. FIG. 17 shows the implementation of step S6 of FIG. 2. FIG. 18 shows a simple example of such a jerk profile r. FIG. 19 shows the corresponding acceleration profile a.

In accordance with FIG. 17, the control device 4 determines the jerk profile r in such a way that each jerk discontinuity resulting at the start and at the end of the jerk profile r as well as at the transition between two sections 13 to 17 can be represented as the sum of a first and a second discontinuity component. The first discontinuity component of a considered jerk discontinuity excites in this case an oscillation of the oscillatory system 2 (that is to say the load 2 in the present case). The second discontinuity component of the considered jerk discontinuity damps an oscillation of the oscillatory system 2 (that is to say, here, the load 2). This oscillation damped by the second discontinuity component of the considered jerk discontinuity has been excited by the first discontinuity component of another jerk discontinuity that lies temporally upstream of the considered jerk discontinuity by half an oscillatory period T.

The jerk discontinuity at the start of the jerk profile r has a second discontinuity component of zero. The jerk discontinuity at the end of the jerk profile r has a first discontinuity component of zero. Arbitrary combinations are possible at the section transitions.

In accordance with FIGS. 18 and 19, in the simplest case the jerk profile r consists of exactly five sections 13 to 17. The first section 13, the third section 15 and the fifth section 17 have the same section lengths. They are equal to half the oscillatory period T. The section lengths T', T" of the second section 14 and the fourth section 16 can be freely selected. In accordance with FIGS. 18 and 19, they are mutually identical in magnitude. Each section 13 to 17 has a jerk value R1 to R5.

The jerk value R2 of the second section 14 has the same sign as the jerk value R1 of the first section 13. However, it is greater than the jerk value R1 of the first section 13. In particular, it lies between the onefold value and the twofold value of the jerk value R1 of the first section 13.

The jerk value R5 of the fifth section 17 has a different sign from the jerk value R1 of the first section 13.

The jerk value R4 of the fourth section 16 has the same sign as the jerk value R5 of the fifth section 17. However, it is greater than the jerk value R5 of the fifth section 17. In particular, it lies at least the twofold value of the jerk value R5 of the fifth section 17.

The jerk value R3 of the third section 15 lies between the jerk values R1, R5 of the first and of the fifth sections 13, 17.

In the simple example of FIGS. 18 and 19, it is not only the jerk discontinuity at the start of the jerk profile r and the jerk discontinuity at the end of the jerk profile r that have only a single discontinuity component—so, too, do the jerk discontinuities inside the jerk profile r. It holds in detail that:

- the jerk discontinuity at the start of the section 13 has only a first discontinuity component. This jerk discontinuity therefore excites an oscillation of the load 2.
- The jerk discontinuity between the sections 13 and 14 has only a second discontinuity component. This jerk discontinuity damps the oscillation that has been excited at the beginning of the jerk profile r.
- The jerk discontinuity between the sections 14 and 15 has only a first discontinuity component. An oscillation of the load 2 is therefore excited.
- The jerk discontinuity between the sections 15 and 16 has only a second discontinuity component. This jerk discontinuity damps the oscillation that has been excited by the jerk discontinuity between the sections 14 and 15.
- The jerk discontinuity between the sections 16 and 17 has only a first discontinuity component. The oscillation of the load 2 is thus excited by this jerk discontinuity.
- The jerk discontinuity at the end of the jerk profile r has only a second discontinuity component. This jerk discontinuity damps the oscillation that has been excited by the jerk discontinuity from section 16 to section 17.

The magnitudes of the jerk values R2, R4 of the second and fourth sections 14, 16 are preferably of the same value as one another. In particular, they can have the same magnitude as the maximum jerk RM. This holds, in particular, whenever the section lengths T', T" of the second and fourth sections 14, 16 are longer than a minimum time which the sections 13 to 17 have imposed on them by the system.

Once an oscillation of the load 2 has been excited, it is easily damped as a rule. It is assumed below that k is a number between zero (excluded) and one (included). It is determined by the equation $$k = \left| \frac{A2}{A1} \right|. \tag{8}$$

A1 and A2 are the amplitudes, relating to two directly consecutive maximum deflections, of a once excited oscillation which is free, that is to say not influenced from outside.

When the jerk values R2 and R4 of the second and fourth sections 14, 16 have the same magnitude R and mutually differing signs, it holds for the jerk values R1, R3 and R5 of the first, the third and the fifth sections 13, 15, 17 that $$R1 = \frac{1}{1+k} R2 \tag{9}$$

$$R3 = \frac{1-k}{1+k} R2 \tag{10}$$

$$R5 = -\frac{k}{1+k} R2. \tag{11}$$

The special case k=1 (that is to say an undamped oscillation) yields R1=R2/2=−R5 and R3=0.

It is possible in a simple way by means of the present invention for a mechanically movable element 1 (here a trolley 1) to move without exciting a lasting oscillation of an oscillatory system 2 (here the load 2).

The above description serves only to explain the present invention. By contrast, the scope of protection is intended to be determined exclusively by the attached claims.

What is claimed is:

1. An operating method for operating an installation having a mechanically movable element configured to an oscillatory system to perform an oscillation with a natural frequency and an oscillatory period corresponding to the natural frequency, the method comprising the steps of:

moving the mechanically movable element with a control device at a speed having a first speed value, setting a second speed value in the control device, determining with the control device a jerk profile composed of adjoining sections having jerk values and discontinuities in the jerk profile between adjoining sections, with the jerk value in a section being constant, expressing a discontinuity as a sum of a first and a second discontinuity component, wherein the first discontinuity component of the discontinuity in the jerk profile excites an oscillation of the oscillatory system and the second discontinuity component of the discontinuity in the jerk profile quiets an oscillation of the oscillatory system previously excited by a first discontinuity component of an earlier discontinuity in the jerk profile, which occurred earlier by half an oscillatory period, and wherein the jerk value changes the speed of the mechanically movable element from the first speed value to the second speed value, and moving the mechanically movable element under control of the control device in accordance with the determined jerk profile.

2. The operating method of claim 1, wherein the jerk profile has five consecutive sections, with a section length of the first, third and fifth section being equal to half the oscillatory period.

3. The operating method of claim 2, wherein jerk values in the five sections have the following relationship:

the jerk value of the second section has an identical sign as the jerk value of the first section and a magnitude between the one time and two times the jerk value of the first section, the jerk value of the fifth section has a different sign from the jerk value of the first section, and the jerk value of the fourth section has an identical sign as the jerk value of the fifth section and has a magnitude of at least two times the jerk value of the fifth section.

4. The operating method of claim 3, wherein magnitudes of the jerk values of the second and fourth sections are identical, wherein the second and fourth sections have identical section lengths, and wherein the jerk value of the third section is intermediate the jerk values of the first and of the fifth sections.

5. The operating method of claim 3, wherein a magnitude of the jerk value of the second section or a magnitude of the jerk value of the fourth section, or both, is equal to a maximum jerk value.

6. The operating method of claim 5, wherein the maximum jerk value in the control device is set by the operator.

7. The operating method of claim 1, further comprising the steps of detecting at least one measured variable of the oscillatory system with a sensor device, and automatically determining with the control device from the at least one measured variable the natural frequency and the associated oscillatory period.

8. The operating method of claim 1, wherein the jerk profile has an initial section and a final section, and further comprising the step of determining with the control device the jerk values of the initial section and the final section, so that a magnitude of a product of the jerk value and a section length of the initial section and of the final section does not exceed a maximum acceleration.

9. The operating method of claim 8, wherein the maximum acceleration in the control device is set by the operator.

* * * * *

UNITED STATES PATENT AND TRADEMARK OFFICE

CERTIFICATE OF CORRECTION

PATENT NO. : 7,997,431 B2
APPLICATION NO. : 12/295899
DATED : August 16, 2011
INVENTOR(S) : Uwe Ladra et al.

It is certified that error appears in the above-identified patent and that said Letters Patent is hereby corrected as shown below:

On the cover page:

[73] Assignee: replace “Müchen” with --München--.

Signed and Sealed this
Eighteenth Day of October, 2011

David J. Kappos

David J. Kappos
*Director of the United States Patent and Trademark Office*